United States Patent [19]

Kima et al.

[11] 3,962,794

[45] June 15, 1976

[54] AUTOMATIC ROLL POSITION MEASURING APPARATUS FOR CONTINUOUS CASTING MACHINE

[75] Inventors: Keisuke Kima, Amagasaki; Yasuo Sugitani, Takarazuka, both of Japan

[73] Assignee: Sumitomo Metal Industries, Ltd., Osaka, Japan

[22] Filed: Oct. 17, 1974

[21] Appl. No.: 515,716

[30] Foreign Application Priority Data

Oct. 24, 1973 Japan ..... 48-123381

[52] U.S. Cl. ..... 33/182; 33/174 L

[51] Int. Cl.[2] ..... G01B 5/14; G01B 7/14; B21B 31/34

[58] Field of Search ..... 33/143 L, 147 K, 147 L, 33/147 N, 174 R, 174 L, 174 Q, 182

[56] References Cited

UNITED STATES PATENTS 713,784 11/1902 Mellor ..... 33/147 K 3,718,019 2/1973 Box et al. ..... 33/182

FOREIGN PATENTS OR APPLICATIONS 1,194,119 5/1959 France ..... 33/174 L 920,239 11/1954 Germany ..... 33/147 K

*Primary Examiner*—Richard E. Aegerter

*Assistant Examiner*—Richard R. Stearns

*Attorney, Agent, or Firm*—Wenderoth, Lind & Ponack

[57] ABSTRACT

In a continuous casting machine, displacement-electricity converters are mounted slidably longitudinally on a long guide having the same radius of curvature as that of the roller apron of the casting machine. The long guide is inserted between the rolls of the roller apron. The displacement of the roller apron with respect to each reference position is measured with the displacement-electricity converters.

7 Claims, 5 Drawing Figures

AUTOMATIC ROLL POSITION MEASURING APPARATUS FOR CONTINUOUS CASTING MACHINE

BACKGROUND OF THE INVENTION

The present invention relates generally to an apparatus for automatically measuring each roll position of the roller apron of a continuous casting machine and, more particularly, to an apparatus for automatically measuring in remote control the roll position of a continuous casting machine of the type commonly called S type or bow type wherein a cast slab formed by casting in a curved mold is bent along a large radius of curvature, straightened, and thereafter taken out in a horizontal direction.

In the continuous casting machine of said type, since the cast slab formed by casting in the mold is straightened gradually with several stages of drawing and straightening rolls and taken out horizontally, there are two very important points, namely position of the rolls or distance between the rolls of the roller apron particularly in the neighborhood of the entrance thereof and accuracy of the radius of curvature of the curved passage. Measurement of this roll position is very difficult since the roller apron is curved along the curved passage. In a heretofore used measuring method a special gauge was inserted in the curved passage and the accuracy of the curvature of the roller apron was detected by human eyes. However, the measurement with the human eyes had disadvantages such as inefficiency, large time loss, low measurement accuracy and inability to increase the working ratio and the product quality.

SUMMARY OF THE INVENTION

Accordingly, an object of the present invention is to provide an apparatus for automatically measuring the position of each roll of the roller apron in a continuous casting machine.

Another object of this invention is to provide an apparatus for electrically detecting displacement of each roll of said roller apron with respect to the reference position thereof.

A further object of this invention is to provide a driving mechanism for moving said detecting apparatus along a circular arc of said roller apron.

A still further object of this invention is to provide an apparatus for returning each roll of said roller apron to the reference position on the basis of the electrical signal detected by said detecting apparatus.

In order to accomplish the above and other objects the apparatus according to the present invention is constructed so that electrical detecting means (for example, differential transformers), mounted on a guide having the same radius of curvature as that of the roller apron to be measured and measuring simultaneously each roll position of a set of rolls spaced radially with respect to the curvature of the roller apron, are automatically moved by a driving motor and the distance between the rolls and the displacement thereof are automatically measured with the electrical signals of the detecting means.

BRIEF DESCRIPTION OF THE DRAWINGS

The invention will be better understood from the following description taken in connection with the accompanying drawings in which.

DESCRIPTION OF THE PREFERRED EMBODIMENT

Figure 1:
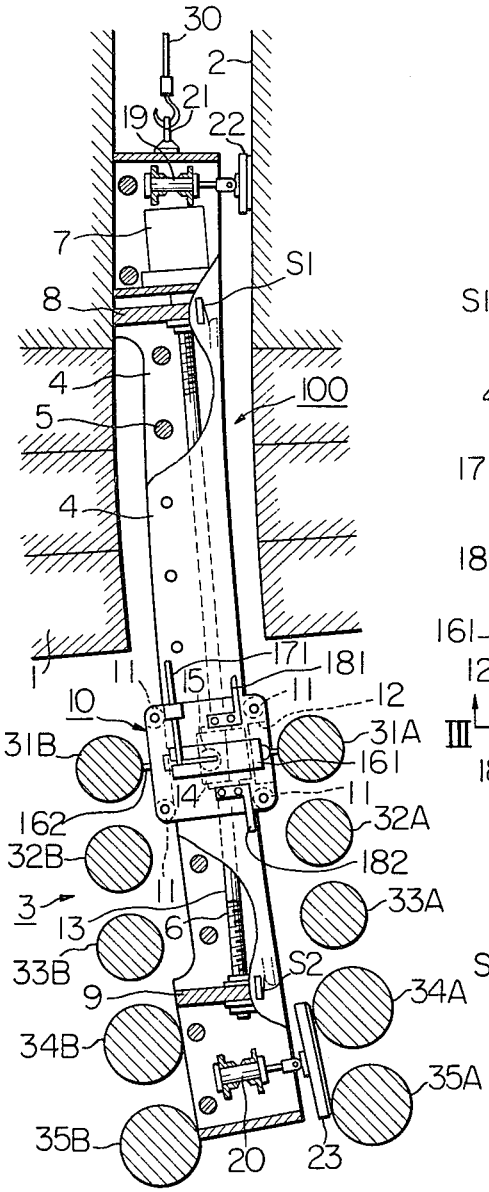
FIG. 1 is a partially broken away side view of the apparatus according to the present invention in operation.

Referring now to the drawings the preferred embodiment of the present invention will be described.

Figure 2:
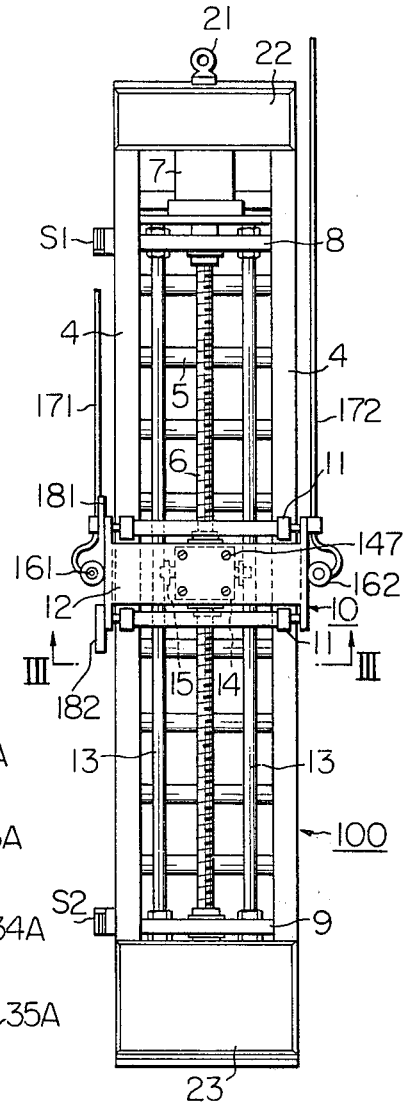
FIG. 2 is a front view of the apparatus.
Figure 3:
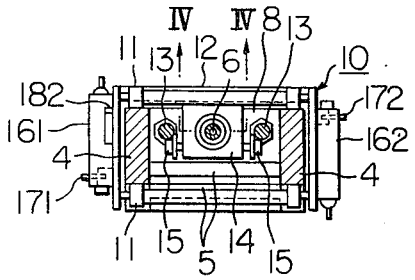
FIG. 3 is a sectional view taken along the line III—III of FIG. 2.

In FIGS. 1 and 2, two long plates 4,4 having the same radius of curvature as those of a mold 1 and a roller apron 3 are connected integrally by means of several pieces of spacer rods 5 having the same length to one another to form a long guide 100. Within the long guide 100 is provided centrally and longitudinally a driving shaft or lead screw 6 having an end thereof connected through a setting plate 8 to a drive motor 7 provided within an end of the guide 100 and the other end supported rotatably by another setting plate 9. On the long guide 100, a truck 10 is mounted which has a measuring apparatus thereon movable along the length of the guide by means of eight rolls 11 (see FIG. 3) pivotally supported on the upper and lower portions thereof. As will be described in detail with reference to FIG. 4, said driving shaft 6 is threaded into an axle bearing or nut 14 connected to a top plate 12 of the truck so as to drive the truck 10 by the motor. Further, in order to prevent shaking of the truck 10 while moving and to stabilize the movement of the truck, two guide shafts 13 are provided along the length of the driving shaft 6 and flanged rolls 15 are mounted rotatably on the right and left sides of the axle bearing 14 so as to rotate along the guide shafts 13 (see FIG. 3).

Figure 4:
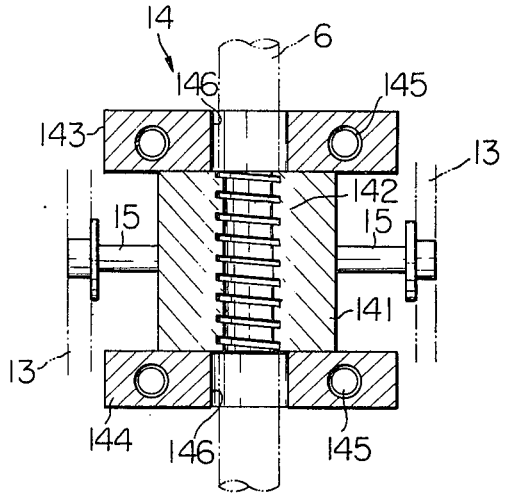
FIG. 4 is a partially enlarged sectional view taken along the line IV—IV of FIG. 3.

As shown in FIG. 4, the axle bearing or nut 14 comprises a nut body 141 and keep plates 143 and 144. The nut body 141 is provided centrally with a female thread 142 for meshing engagement with the thread of the driving shaft 6. The nut body 141 is positioned between the keep plates 143 and 144 and is only in a face-to-face contact with them so as to be slidably movable with respect to them. The driving shaft 6 is made to pass loosely through slots 146 provided centrally through the keep plates 143 and 144. As illustrated, since the keep plates 143 and 144 are provided on the top portions thereof with female threads 145, these keep plates are fixed onto the truck top plate 12 by means of bolts 147. On the sides of the nut body 141 are mounted said flanged rolls 15.

Since rotation of the nut body 141 is arrested by engagement between the rolls 15 and the guide shafts 13, when the driving shaft is rotated the axle bearing 14 as a whole moves along the driving shaft 6. At this time, the keep plates 143 and 144 can move relatively to the nut body 141 in the direction perpendicular to the paper face of FIG. 4.

On the sides of the truck 10 is mounted a detector, comprising, for example, two differential transformers 161 and 162, for measuring simultaneously the positions of a set of rolls spaced back and forth in the roller apron, so that, as will be described in detail with reference to FIG. 5, electrical signals produced by said transformers are taken out to be recorded by lead wires 171 and 172 or that the roll position is adjusted in remote operation. For remote operation of the truck 10, the upper and lower portions of the guide are provided respectively with a limit switch S1 for upper limit and a limit switch S2 for lower limit. The truck 10 is provided with projections 181 and 182 so that moving direction of the truck is automatically changed when any of the limit switches touches one of the projections. As illustrated, an air cylinder 19 is mounted on a support (not shown) extending across the upper ends of the long plates 4 and another air cylinder 20 is likewise mounted on a support (not shown) extending across the lower ends of the long plates 4. At ends of piston rods of respective air cylinders 19 and 20 are rotatably mounted holding plates 22 and 23 respectively. The air cylinders, as will be described below, serve to fix the apparatus body in the curved passage of the mold and the roller apron.

Since the roller apron 3 itself is well known to those skilled in the art, there will be no need to describe it herein in detail. In a continuous casting machine, as described, the quality and size of the steel slab produced thereby are greatly influenced by the distance between the rolls of the roller apron along the curved passage particularly in the neighborhood of the entrance thereof and the accuracy of the radius of curvature of the curved passage. For this reason, FIG. 1 shows the roller apron 3 particularly in the neighborhood of the entrance thereof only. As shown in FIG. 1, the roller apron 3 comprises curvature-radially inner rolls 31A, 32A, 33A, 34A, 35A .... and curvature-radially outer rolls 31B, 32B, 33B, 34B, 35B .... which are arranged respectively in a pair and spaced a predetermined distance from each other. In this embodiment, the inner and outer rolls from the top to, for example, the third stange 31A, 32A, 33A and 31B, 32B, 33B are arranged so as to be movable curvature-radially respectively by suitable means (not shown). On the other hand, the inner and outer rolls 34A, 35A and 34B, 35B of the fourth and fifth stages are fixed at the centers thereof so that they are rotatable about their centers but not movable curvature-radially.

The aforedescribed roller apron 3 is only an example and it should be understood that the inner and outer rolls of more stages can be arranged curvature-radially. The ensuing description will make it clear that the apparatus according to the present invention is applicable to such roller apron having more than five stages of rolls.

The operation of the apparatus according to the present invention will now be described.

Firstly, the long guide 100 suspended by a rope 30 hooked to a lifting device 21 provided at the top of the guide 100 is inserted into the curved passage of the mold 1 and the roller apron 3 of the continuous casting machine with the truck 10 moved to the prescribed position on the long plate 4. When the long guide 100 is lowered within the curved passage to the prescribed depth, the holding plate 22 mounted pivotally at the end of the piston rod is pressed by the air cylinder 19 provided at the upper end of the guide against the cooling mold 2 and the other holding plate 23 is pressed by the air cylinder 20 provided at the lower end of the guide against the fixed inner rolls 34A and 35A of the fourth and fifth stages to thereby fix the long guide 100.

Then, a master gauge (not shown) is put to the differential transformers 161 and 162 facing respectively inwardly and outwardly of the radius of curvature to perform zero point adjustment. Thereafter, by moving the truck 10 up or down by the drive motor 7, positions of the inner and outer rolls of the first stage are simultaneously detected by the two differential transformers 161 and 162. Upon completion of measurement of this portion, the long guide 100 is horizontally moved a suitable distance widthwise, namely in a direction perpendicular to the paper face of FIG. 1 and said operation is repeated to measure deviations of the inner and outer rolls. Normally, this measurement operation is repeated two or three times along the widthwise direction of the curved passage. The measurement is performed in the inner and outer rolls of the second stage, third stage and so forth, sequentially.

Figure 5:
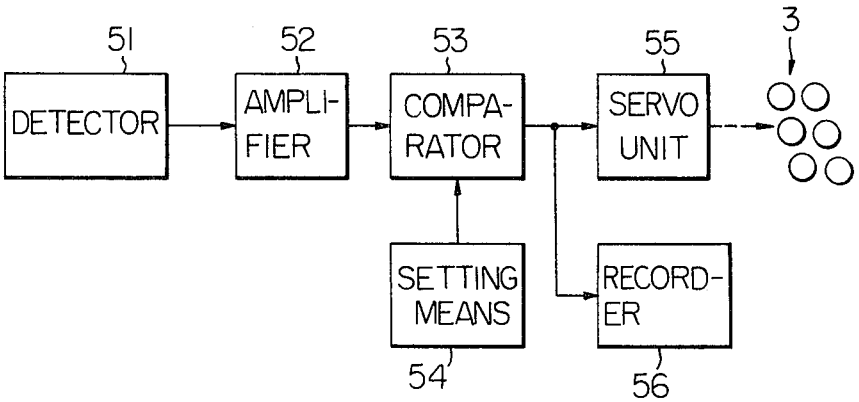
FIG. 5 is a schematic block diagram of an arrangement for controlling the position of each roll of the roller apron using the apparatus according to the present invention.

With reference to FIG. 5, utilization of the results of the measurements will now be described. A signal detected by a detector 51 (for example, differential transformers) is amplified by an amplifier 52, compared by a comparator 53 with a set reference value from setting means 54, and a difference signal therefrom is transmitted to a servo unit 55 and a recorder 56. Based on the difference signal the servo unit 55 automatically corrects each roll position of the roller apron 3. Alternatively, an operator may manually correct each roll position based on the data recorded in the recorder 56.

According to the present invention, as described hereinabove, since the roll position can be detected remotely and automatically simply by moving the truck having detecting means thereon up or down, the time required for measuring the roll positions can be drastically reduced. Also, since the measurement is performed electrically, the accuracy of measurement is high and the rate of operation and the quality of products can be greatly increased. Further, since the apparatus according to the present invention is structurally simple, it can be produced at a low cost, and since the sliding and supporting portions are built solidly, loosening or damage thereof is very rare even under a severe operating condition. Thus, the present invention has a high practicability.

While we have shown and described specific embodiments of our invention, it will be understood that these embodiments are merely for the purpose of illustration and description and that various other forms may be devised within the scope of the invention as defined in the appended claims.

We claim:

1. An automatic roll position measuring apparatus for use in a continuous casting machine which has a mold portion and a roller apron defining a curved guide path, said apparatus comprising:

an elongated guide slidably fitted within said mold portion and roller apron having a radius of curvature the same as the radius of curvature defined by said mold portion and said roller apron;

a truck carriage slidably mounted on said elongated guide and movable in the longitudinal direction therealong;

detector means mounted on said truck carriage and contacting said rolls of said roller apron for electrically detecting displacements of said rolls with respect to the reference positions thereof; and driving means operatively connected to said truck carriage for moving said truck carriage and said detector means mounted thereon in the longitudinal direction of said elongated guide.

2. An apparatus as claimed in claim 1, wherein said driving means is comprised of:

a threaded drive shaft mounted in the longitudinal direction of said elongated guide motor means connected to said drive shaft for rotating said drive shaft and an axle bearing means connected to said truck carriage and engaging said drive shaft for longitudinally moving said carriage in response to rotational movement of said drive shaft.

3. An apparatus as claimed in claim 2, wherein said axle bearing means is comprised of:

a pair of spaced keep plates fixed to said truck carriage and having a slot through each surrounding said drive shaft; and a nut body engaged with said drive shaft and slidably fitted between said keep plates.

4. An apparatus as claimed in claim 3, further comprising:

guide shafts on both sides of said drive shaft along the longitudinal direction thereof; and flanged rolls connected to said nut body, extended outward therefrom and engaged with said guide shafts.

5. An apparatus as claimed in claim 1, wherein said detector means is comprised of:

a pair of differential detector transformers mounted on said truck carriage, one of said differential transformers having the detecting end thereof faced toward the inside with respect to said radius of curvature and the other differental transformer having the detecting end thereof faced toward the outside with respect to said radius of curvature.

6. An apparatus as claimed in claim 1, further comprising:

fixing means mounted at both ends of said elongated guide for fixing said elongated guide within said curved guide path defined by said mold portion and said roller apron.

7. An apparatus as claimed in claim 6, wherein said fixing means is comprised of:

a piston air cylinder and a holding plate mounted on each end of said elongated guide, each holding plate being mounted for pivotal movement about an axis parallel to the axis of said curved guide path at the ends of the piston rod of the associated air cylinder.

* * * * *